US005197784A

United States Patent [19]

Holder

[11] Patent Number: 5,197,784

[45] Date of Patent: Mar. 30, 1993

[54] APPARATUS FOR REMOVING FLOOR COVERING

[76] Inventor: Tommie Holder, 306 7th St., Snyder, Okla. 73566

[21] Appl. No.: 783,449

[22] Filed: Oct. 25, 1991

Related U.S. Application Data

[63] Continuation-in-part of Ser. No. 638,284, Jan. 7, 1991, Pat. No. 5,082,330.

[51] Int. Cl.[5] ..... B32B 31/18; E21C 47/00

[52] U.S. Cl. ..... 299/37; 15/93.1; 30/170

[58] Field of Search ..... 299/36, 39, 41, 37; 30/170, 172; 15/93.1; 51/174, 175, 176, 177; 29/81.6; 81/45

[56] References Cited

U.S. PATENT DOCUMENTS

| | | | |
|---|---|---|---|
| 1,442,544 | 1/1923 | Schwnke | 30/170 |
| 2,864,104 | 12/1958 | Le Sage | 15/93.1 |
| 2,913,855 | 11/1959 | Vinella | 51/177 |
| 2,973,536 | 3/1961 | Doyle | 15/93.1 |
| 3,007,687 | 11/1961 | Hatcher | 299/39 |
| 3,098,329 | 7/1963 | Doran | 51/177 |
| 3,347,596 | 10/1967 | Brejcha et al. | 262/20 |
| 4,099,328 | 7/1978 | Schlemmer | 30/172 |
| 4,172,615 | 10/1979 | Hakes | 299/30 |
| 4,486,931 | 12/1984 | Pichelman et al. | 15/93.1 X |
| 4,523,361 | 6/1985 | Dumermuth | 29/81 J |
| 4,592,108 | 6/1986 | Svendsen | 15/4 |
| 4,614,380 | 9/1986 | Allen | 299/41 |
| 4,668,017 | 5/1987 | Peterson et al. | 299/37 |
| 4,756,578 | 7/1988 | Mims et al. | 299/37 |
| 4,848,845 | 7/1989 | Kennedy | 299/39 |
| 5,082,330 | 1/1992 | Holder | 299/37 |

*Primary Examiner*—David J. Bagnell
*Attorney, Agent, or Firm*—Dunlap Codding & Lee

[57] ABSTRACT

An apparatus for removing floor covering which has a frame supported by wheels. Some of the wheels are used to drive the frame and these wheels are powered by a structurally independent power source. A tool secured to the frame, may be used to push up floor covering.

16 Claims, 5 Drawing Sheets

APPARATUS FOR REMOVING FLOOR COVERING

CROSS-REFERENCE TO RELATED APPLICATIONS

This application is a continuation-in-part of U.S. Ser. No. 638,284, filed Jan. 7, 1991 and entitled AN APPARATUS FOR REMOVING FLOOR COVERING now U.S. Pat. No. 5,082,330 issued Jan. 21, 1992.

FIELD OF THE INVENTION

The present invention relates generally to an apparatus for removing floor coverings.

SUMMARY OF THE INVENTION

The present invention comprises powerful, compact, and agile apparatus for removing floor covering. The apparatus comprises a frame with wheels for supporting and driving the frame. A tool secured to the frame may be used to remove floor covering.

BRIEF DESCRIPTION OF THE DRAWINGS

FIG. 8 is a rear elevation of the apparatus of FIG. 6.

DETAILED DESCRIPTION OF THE PREFERRED EMBODIMENTS

Figures 1, 2:
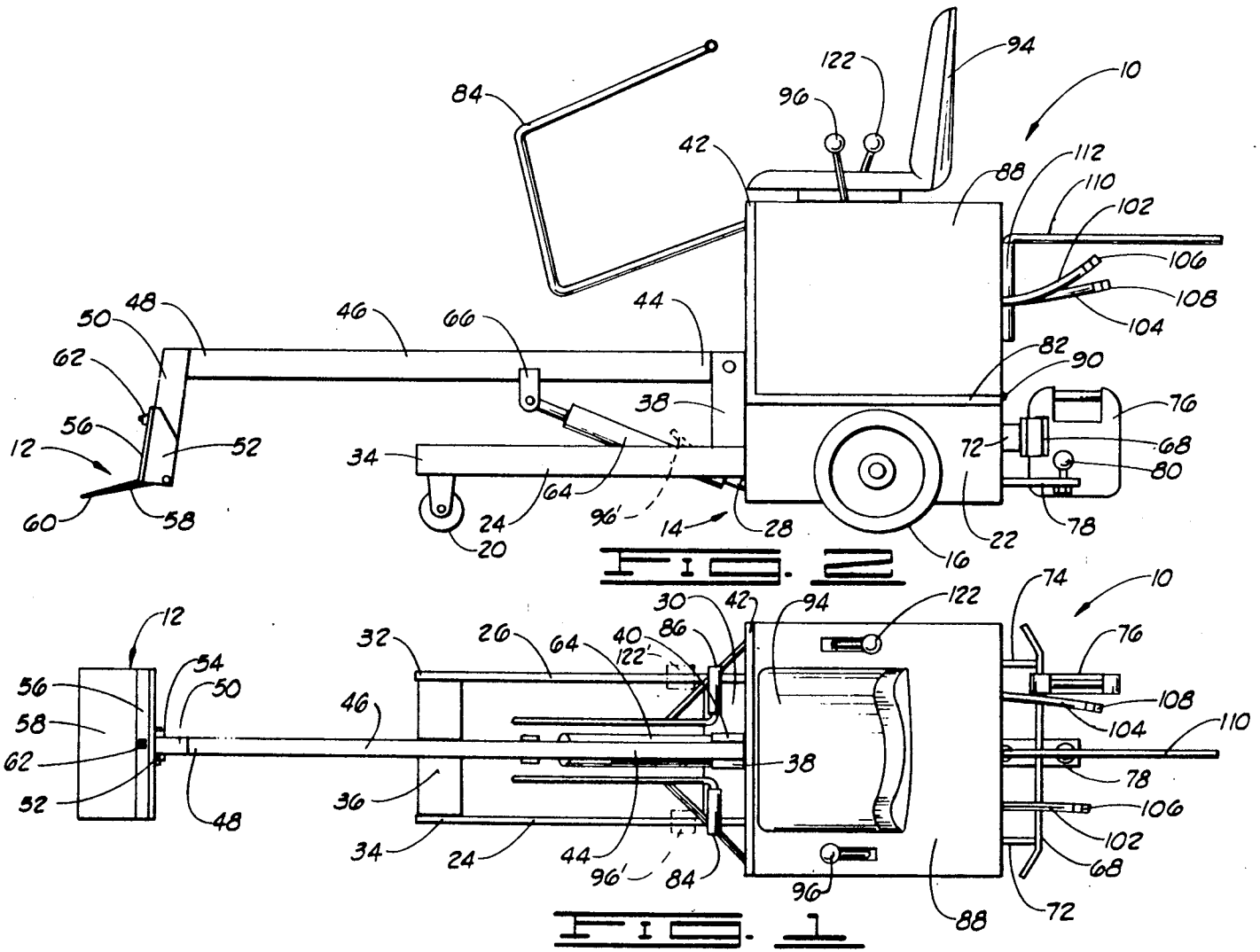
FIG. 1 is a plan view of the apparatus constructed in accordance with the invention.
FIG. 2 is a side elevation of the apparatus of FIG. 1.
Figure 3:
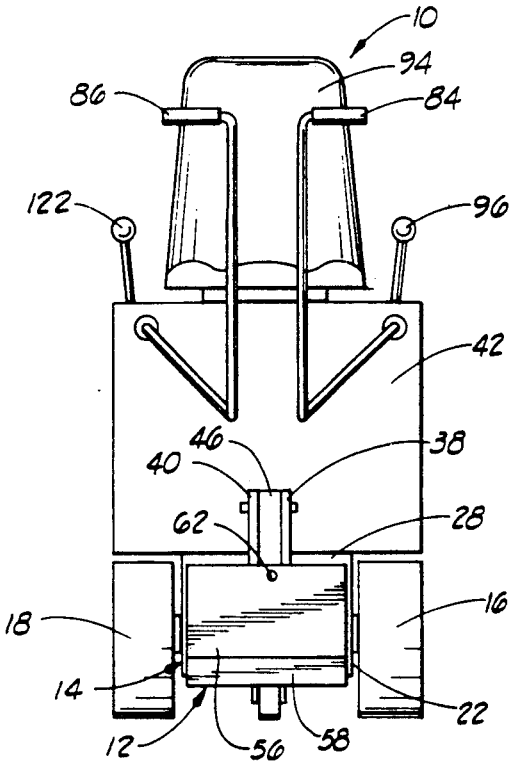
FIG. 3 is a front elevation of the apparatus of FIG. 1.
Figure 4:
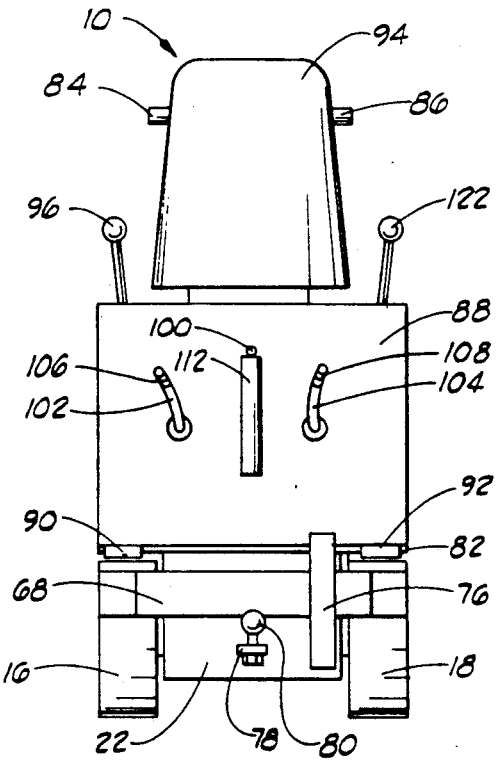
FIG. 4 is a rear elevation of the apparatus of FIG. 1.

Referring to the drawings in detail, reference number 10 generally designates a floor cover removing apparatus constructed in accordance with this invention. The apparatus 10 basically comprises a blade 12 secured in front of a frame 14 which is supported by wheels 16, 18 and 20.

The frame 14 has a rectangular base housing 22 with a pair of parallel beams 24 and 26 extending forwardly from the front side 28 thereof. A first brace 30 (FIG. 1) is secured to the rectangular base housing 22 and to each beam 24 and 26. Secured between ends 32 and 34 of the beams 24 and 26 is a second brace 36.

Drive wheels 16 and 18 are rotatably secured to opposite sides of the rectangular base housing 22. A caster wheel 20 is secured under the second brace 36 such that it will allow the frame to turn and move in any direction.

A pair of vertical parallel plates 38 and 40 are welded to the front side of the rectangular base housing 22, the first brace 30 and a front panel 42.

The first end 44 of a generally horizontal lift arm 46 is pivotally secured between the parallel plates 38 and 40. The second end 48 of the lift arm 46 extends forward past the ends, 32 and 34, of the beams 24 and 26. Secured to the second end 48 of the lift arm 46 and extending down therefrom is arm 50 adapted for pivotally mounting the blade 12.

The blade 12 is comprised of a pair of vertical parallel braces 52 and 54, a back plate 56 and a cutting plate 58. A flexible shear blade 60 (FIG. 2) may be secured to the cutting plate 58. It has been found that when removing tile it is preferable to secure the flexible shear blade 60 to the cutting plate 58. An anchor bolt 62 is secured through the back plate 56 and to the arm 50 to allow adjustment of the blade 12.

The lift cylinder 64 extends from the rectangular base housing 22 up to a bracket 66 welded to a midpoint on the lift arm 46. The lift cylinder 64 is adapted to raise and lower the lift arm 46.

Secured to the rear of the rectangular base housing 22 is a weight holder 68. The weight holder 68 is secured to the rectangular base housing 22 by a pair of mounts 72 and 74. The weight holder 68 is a sufficient size and strength to hold eight forty-two pound tractor type weights, such as weight 76. In addition to the rear weight holder 68, the beams 24 and 26 may also hold as many as five forty-two pound tractor weights each. Thus, one may add over 750 pounds of weight to the apparatus 10 thereby significantly increasing traction. In addition, a significant portion of this weight may be transferred to the blade 12 via the lift cylinder 64, thus preventing the blade 12 from riding over a floor covering.

An arm 78 has one end welded to the rear of the rectangular base housing 22 and a hole (not shown) cut in the opposite end to provide a location for attaching a trailer ball 80.

Secured above the rectangular base housing 22 is an upper base 82, and a front panel 42. Protruding through the front panel 42 are a pair of steering arms 84 and 86. Each steering arm controls the direction of rotation of a drive wheel.

An upper housing 88 is secured by hinges 90 and 92 to the rear of the upper base 82. On top of the upper housing 88 is an operator's seat 94.

Extending through the top of the upper housing 88 is a lift control lever 96. As is shown in FIGS. 1 and 2, the lift control lever 96 may be replaced with a foot pedal 96'.

Extending from the rear of the upper housing 88 are a pair of flexible conduits 102 and 104 with quick disconnects 106 and 108, and a pivotally mounted conduit holder 110.

The conduit holder 110 is an L-shaped rod pivotally secured in a hollow tubing 112. The hollow tubing 112 is secured, as by welding, to the upper housing 88 so that it extends vertically. The diameter of the conduit holder 110 is less than the diameter of the opening through the hollow tubing 112, thus, the conduit holder 110 can pivot from side to side. In this way, when the apparatus 10 is backed up, the conduit holder 110 will swing the conduits out of the way so they are not run over.

Figure 5:
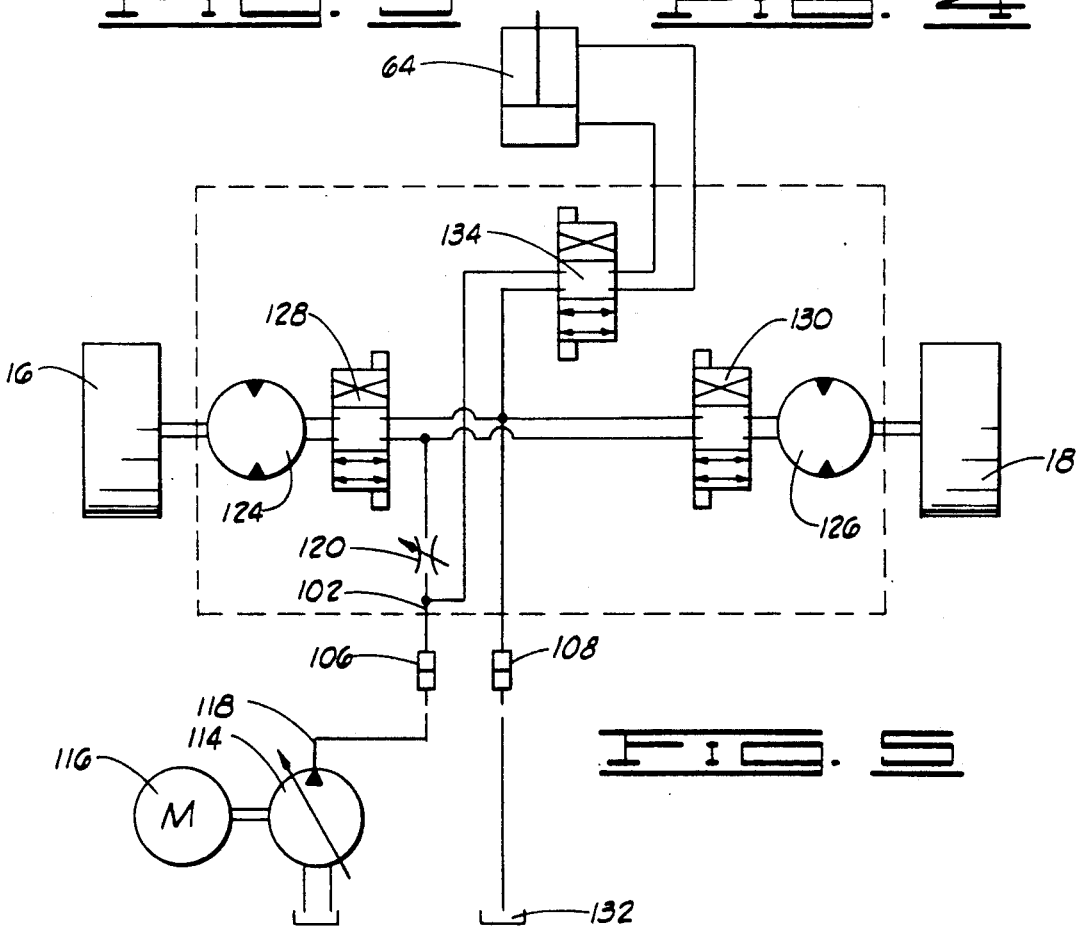
FIG. 5 is a schematic of the hydraulic system of the apparatus of FIG. 1.
Figure 5:
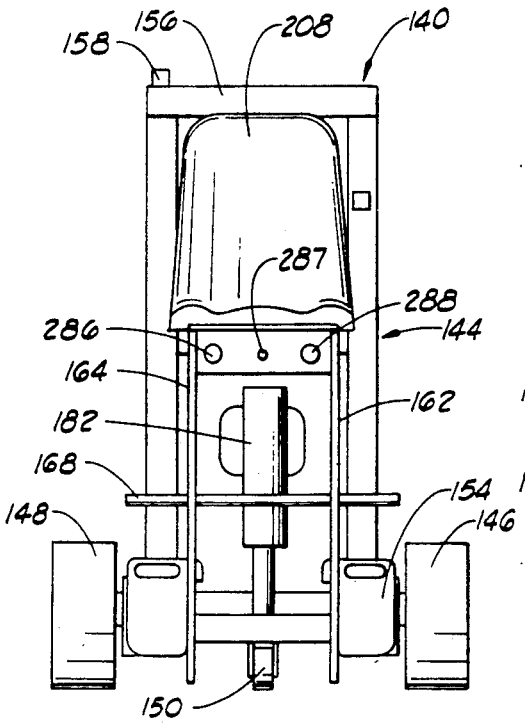

As shown in FIG. 5, the apparatus 10 is powered by a structurally independent pump 114. In this way, a large motor 116, such as one which produces 25 HP or more may be used to power the apparatus 10. By utilizing an external power source the apparatus 10 may still be built small enough to easily maneuver through a building. The overall width of the apparatus 10 should be less than the door width, preferably less than two feet, so that interior doorways are not a barrier.

Fluid flowing from the independent pump 114 passes through external conduit 118, through the quick disconnect 106 and through conduit 102. From conduit 102 the fluid traverses the variable restricting valve 120. The variable restricting valve 120 is connected to a control lever 122 or to a foot pedal 122' (FIG. 1). The variable restricting valve 120 determines the amount of fluid which may flow to motors 124 and/or 126 thereby dictating the speed of the apparatus 10.

The fluid then passes through valve 128 and/or valve 130, through the motor 124 and/or 126, and back to supply reservoir 132. Valves 128 and 130 are controlled by steering arms 84 and 86 respectively (FIGS. 1–4). It should be noted that by moving one control lever one direction and the other control lever the opposite direction, the apparatus 10 may be made to turn about a point, thus further increasing the ability of apparatus 10 to work in close quarters.

The lift cylinder 64 is controlled by valve 134. The valve 134 is connected to lift control lever 96.

Another preferred embodiment is shown in FIGS. 6 through 14 and is generally designated by the reference numeral 140. The apparatus 140 basically comprises a detachable tool 142 connected to the front of frame 144 which is supported by wheels.

Figure 7:
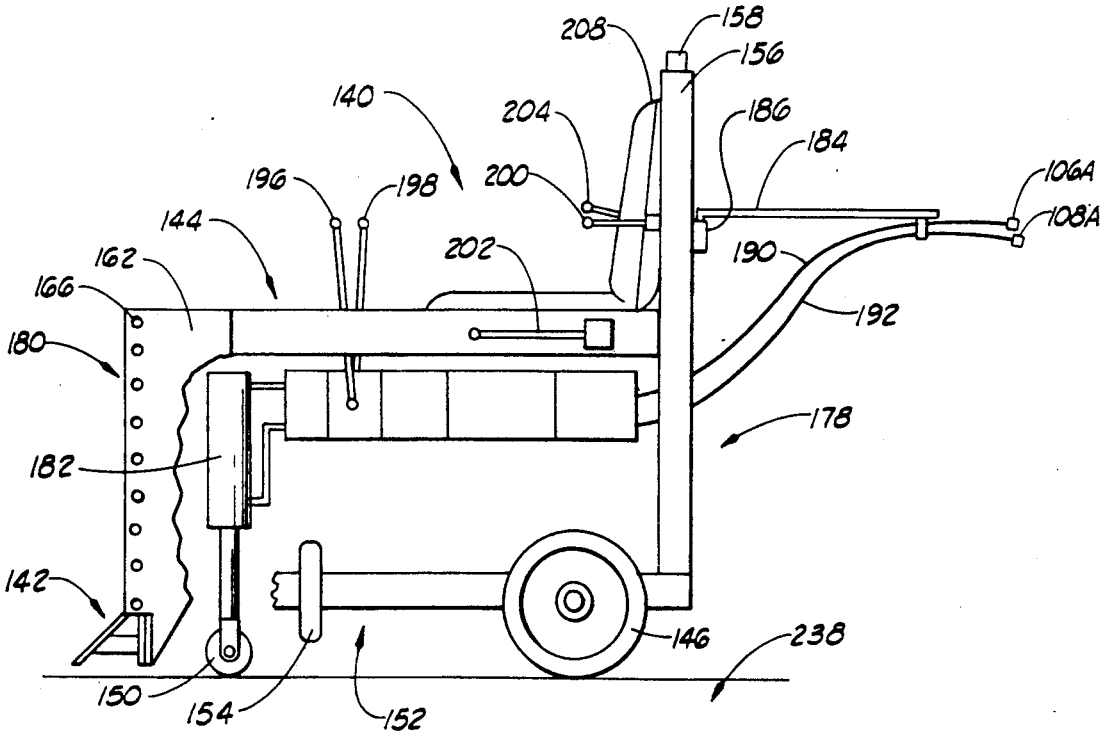
FIG. 7 is a side elevation of the apparatus of FIG. 6.

The frame 144 has a base portion 152 adapted to hold a plurality of weights, such as weight 154 shown in FIG. 7. The weight 154 may be a weight such as is commonly known as a forty two pound tractor weight. This type of weight is adapted to be easily added or removed from a frame member so one may easily add additional weight to the apparatus 140 hereby increasing traction.

Incorporated into the frame is an oil storage tank 156 which functions as an oil reservoir for the variable drive motors discussed below. The oil storage tank 156 has a fill cap and vent 158 for filling the oil storage tank 156 and equalizing the pressure inside the tank and the atmospheric pressure outside the tank 156.

The frame also includes an assembly 160 (FIG. 9) for detachably supporting tools such as a blade. The assembly 160 includes a pair of vertical plates 162 and 164, having a plurality of holes 166 (only one hole 166 being designated on FIGS. 7 and 9). Bar 168 extends through a pair of holes 166 to provide a foot rest for the operator. A back up plate 170 and a retaining band 172 are secured between the two vertical plates 162 and 164 to provide support for tools which may be attached to the frame 144.

The back up plate 170 and the retaining band 172 each have a hole formed therein about midway between the two vertical plates 162 and 164. The holes are sized and adapted to except a pin 174. The pin 174 may be movingly connected to the back up plate 170 by a piece of spring steel 176.

Figure 6:
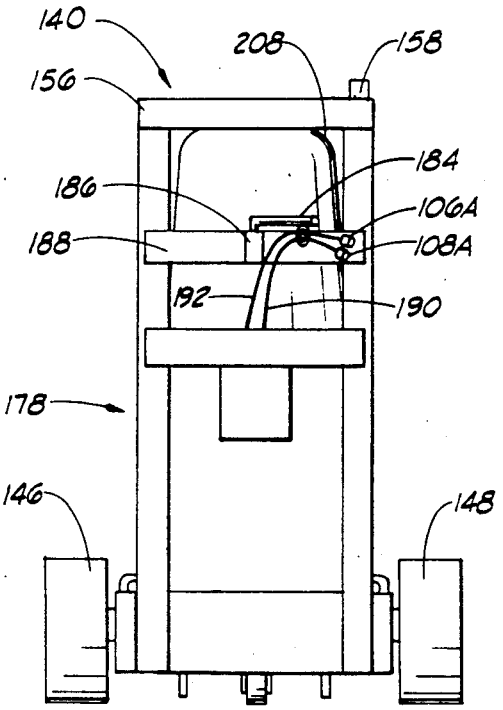
FIG. 6 is a front elevation of another embodiment of an apparatus constructed in accordance with the invention.

Referring to FIGS. 6–8, drive wheels 146 and 148 are rotatably secured to opposite sides of the frame 144 generally near the rear 178 of the frame 144. The drive wheels are powered by a pair of motors which will be described in detail below.

Caster wheel 150 is connected to the frame via a hydraulic lift cylinder 182. The cylinder is positioned and adapted to extend and retract the caster wheel 150 so as to raise and lower the frame 144 and in particular to raise and lower the tool 142 connected to the frame 144.

Referring to FIGS. 7 and 8 a pivotally mounted conduit holder 184 extends from the rear 178 of the frame 144 to support a pair of conduits 190 and 192. The conduit holder 184 may be an L-shaped rod pivotally secured in a hollow tubing 186. The hollow tubing 186 may be secured, as by welding, to the frame via a support strap 188 or similar member.

Several levers are used to control and drive the apparatus 140, including steering arms 196 and 198, disconnect lever 200, tool supply lever 202 and lift lever 204.

A seat 208 is secured to the frame 144 so an operator may comfortably mount and operate the apparatus 142.

Figure 10:
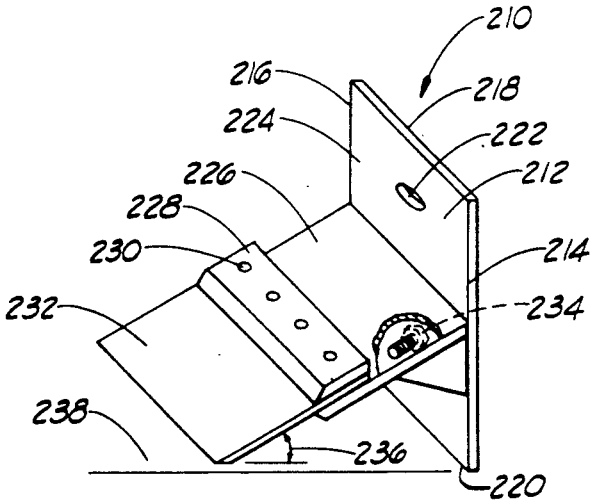
FIG. 10 is a perspective view of a blade type tool for the apparatus of FIG. 6.
Figure 11:
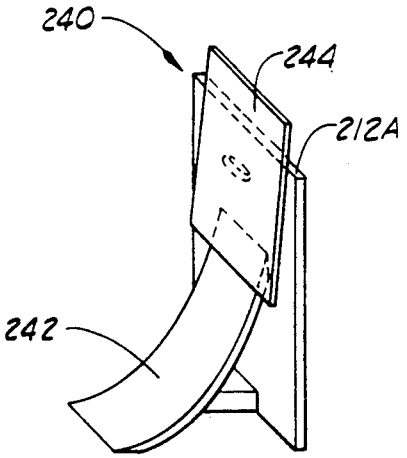
FIG. 11 is a perspective view of a second blade type tool for the apparatus of FIG. 6.
Figure 12:
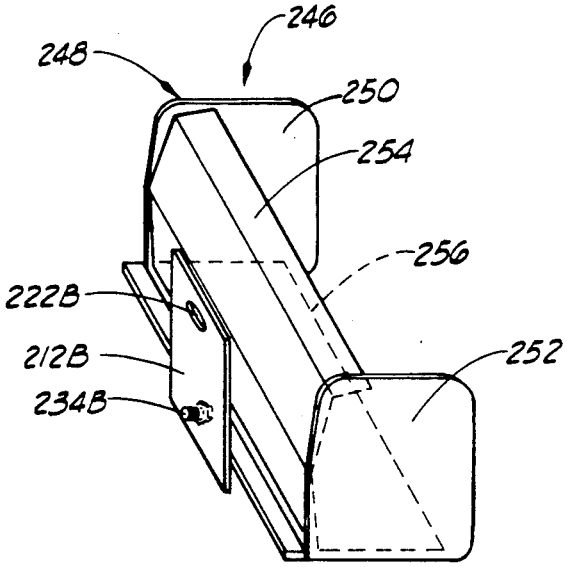
FIG. 12 is a perspective view of a third blade type tool for the apparatus of FIG. 6.

A variety of tools may be connected to the apparatus 140, including blades and rotary cutters. FIGS. 10 through 12 disclose several blade type tools adapted for use with the apparatus and FIG. 13 discloses a rotary tool which is adapted for use with this apparatus.

FIG. 10 shows one embodiment of a blade type tool which may be connected to the apparatus 140. The blade tool 210 has a mounting plate 212 with a left end 214, a right end 216, an upper end 218 and a lower end 220. Generally midway between the left end 214 and the right end 216 and near the upper end 218 is a slot 222. The slot 222 is sized so the pin 174 (FIG. 9) may pass therethrough.

A blade support plate 226 is secured to the face 224 of the mounting plate 212. A blade retaining strap 228 is removably secured, such as by bolts 230, to support plate 226 such that a flexible blade 232 may be attached to the tool 210.

Preferably an angle adjusting bolt 234 is screwably attached to the lower end 220 of the mounting plate 21 generally midway between the left side 214 and the right side 216. In this way, the angle 236 between the blade and the surface 238 may be adjusted; that is, the blade may be pivotally adjusted along a generally horizontal axis which is parallel to the front side of the frame. It has been found that for this type of tool the angle 236 is preferably from about 20° to 45°. This type of tool has been found to be particularly useful in removing asbestos tile.

FIG. 11 shows another embodiment of a blade type tool. The blade tool 240 has a mounting plate 212A as described above in relation to blade tool 210. On blade tool 240 the blade 242 is preferably curved. In addition the blade 242 may be narrower and less flexible than the blade 232 on blade tool 210. Blade tool 242 preferably has a angle adjusting screw as described in relation to blade tool 210. A deflector shield 244 may also be included to deflect chunks of floor covering. This embodiment has been found particularly useful in removing ceramic tile.

FIG. 12 shows yet another blade type tool utilizing a box type shape. The box blade 246 includes a mounting plate 212B with a slot 222B and angle adjusting bolt 234B as described above. Secured to the face of the mounting plate 212B is a box 248 having sides 250 and 252, back 254 and blade 256. The blade 256 may be flexible similar to that in blade tool 210 or rigid as discussed with regard to blade tool 240. This blade tool has proven to be particularly useful in removing loose floor covering from the area being worked upon.

Figure 13:
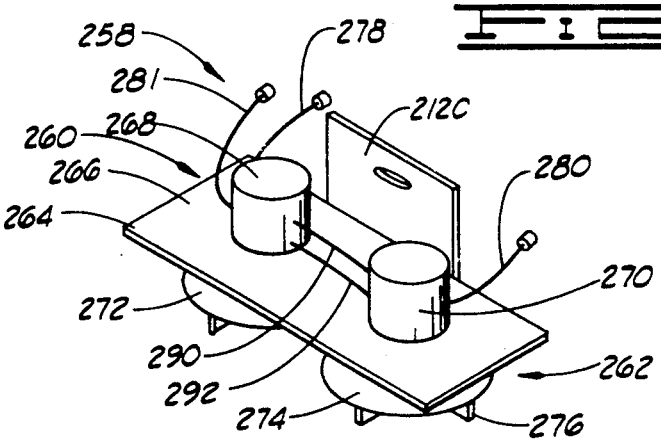
FIG. 13 is a perspective view of a rotary type tool for the apparatus of FIG. 6.

FIG. 13 shows a rotary type tool 258 having two rotary units 260 and 262, and a mounting plate 212C (it should be noted that the rotary tool 258 may have any number of rotary units). The mounting plate 212C, is similar in construction to mounting plate 212 described above. Secured to the face of the mounting plate 212C is a horizontal motor deck 264. The motor deck 264 is secured to the mounting plate 212C, as by welding. Mounted on the upper side 266 of the motor deck 264 are cutter drive motors 268 and 270. Drive shafts (not shown) extend from motors 268 and 270 through the motor deck 264 to blade holders 272 and 274 respectively. Connected to each blade holder 272 and 274 are a plurality of blades 276 (only one blade 276 being designated in FIG. 13).

Conduits 278, 280 and 281 having quick connects are adapted to connect to the apparatus 140 via connectors 286, 287 and 288 respectively (see FIG. 6). Conduits 290 and 292 are connected between the drive motors 268 and 270.

Figure 14:
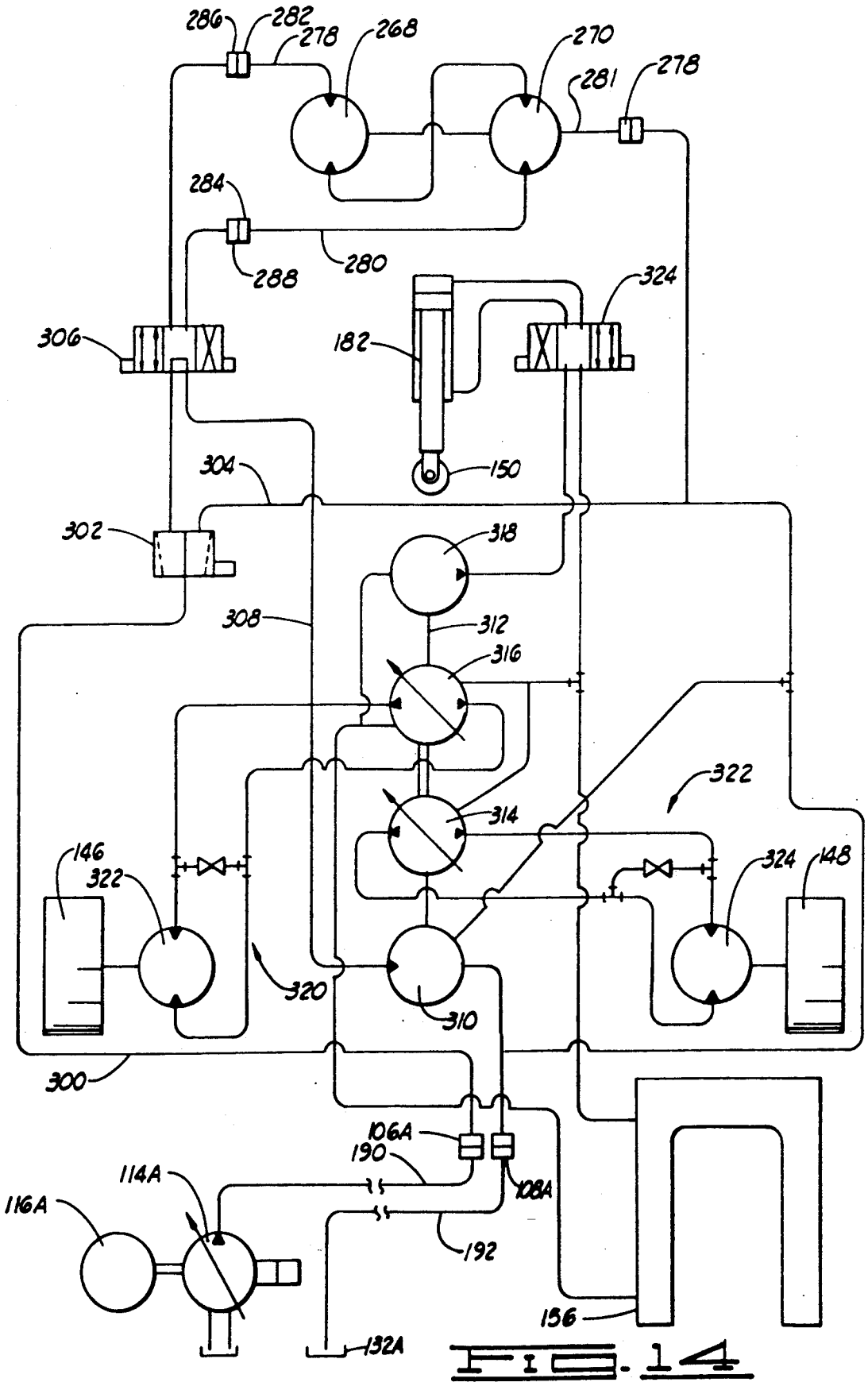
FIG. 14 is a schematic of the hydraulic system of the apparatus of FIG. 6.

As shown in FIG. 14 a structurally independent pump 114A is powered by motor 116A and provides a flow of fluid through conduit 190, connector 106A, conduit 300 and to disconnect valve 302. Disconnect valve 302 is operated by disconnect lever 200 (FIG. 7), and in one position directs the fluid through the conduit 304 back to the supply reservoir 132A. In another position of the valve 302, fluid is directed to tool supply valve 306.

Tool supply valve 306 preferably has three positions, one position to direct the flow of fluid through conduit 278 to cutter drive motors 268 and 270 such that the cutters are rotated in one direction. A second position of valve 306 directs the flow of fluid through conduit 281 to the cutter drive motors 268 & 270 to rotate the cutters 276 in an opposite direction. The third position of valve 306 bypasses the cutter motors altogether.

After the flow of fluid has passed through cutter drive motors, or has been bypassed around the cutter drive motors, the fluid passes through conduit 308 to drive motor 310. Drive motor 310 provides the power to operate the on board hydraulic system to be described in detail below. It has been found to be advantageous to direct the fluid flow to the cutter motors 268 and 270 before it reaches the drive motor 310. In this way, if the cutters encounter an increased load, the fluid flow to the drive motor is reduced, thereby slowing the speed of the drive wheels.

The drive motor 310 rotates a shaft 312 which powers variable displacement pump 314, variable displacement pump 316 and lift pump 318.

Variable displacement pump 314 circulates fluid through the left wheel circuit 320, thereby causing left wheel motor 322 to rotate wheel 146. The speed and direction of rotation of the wheel 146 is controlled by steering arm 196 (FIG. 7).

Similarly variable displacement pump 316, circulates fluid through the right wheel circuit 322, thereby causing right wheel motor 324 to rotate wheel 148. The speed and direction of rotation of wheel 148 is controlled by steering arm 198 (FIG. 7).

Lift pump 318 provides fluid flow to hydraulic lift cylinder 182. Lift valve 324 directs the fluid so as to extend, retract or hold the caster wheel 150 which is secured to the hydraulic cylinder 182. The oil storage tank 156 supplies fluid for the variable displacement pumps 314, 316 and lift pump 318.

Figure 9:
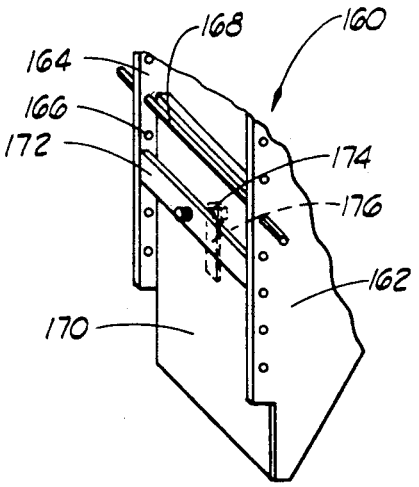
FIG. 9 is an enlarged perspective view of the front portion of the apparatus of FIG. 6.

In operation, a tool such as disclosed in FIGS. 10 through 13 is connected to the front of the apparatus. To connect the tool the mounting plate 212 is placed between the back up plate 170 and the retaining band 172 (FIG. 9). The pin 174 is positioned so as to extend through the hole in the back up plate 170, the slot 222 in the mounting plate 212 and the hole in the retaining band 172. Then, any conduits necessary to run motors on the tool are connected to the connectors 286, 287 and 288.

Since the mounting plate 212 has a slot 222, the tool may pivot slightly along an axis generally perpendicular to the front 180 of the frame 144. In this way, the tool may stay in contact with the surface 238 even though the surface 238 is slightly uneven or if a wheel 146 or 148 rolls over some debris.

Once the structurally independent pump 114A has been started and connected to the apparatus 140 via conduits 190 and 192, the operator may mount the apparatus 140 and control its operation through levers 196, 198, 200, 202 and 204. Levers 196 and 198 control the direction and speed of rotation of wheels 146 and 148 respectively. Lever 200 is a bypass to divert the flow of fluid from the structurally independent pump 114A back to the supply reservoir 132A without operating any of the pumps or motors on the apparatus 140. Lever 202 engages any motors mounted on the tool, and lever 204 raises or lowers the frame 144 so that the tool may be brought into contact with the surface 238.

Changes may be made in the combinations, operations and arrangements of the various parts and elements described herein without departing from the spirit and scope of the inventions as defined in the following claims.

What is claimed is:

1. An apparatus for removing floor covering comprising:

a frame having a front side;

a tool connected to the frame wherein the tool is pivotally connected to said frame such that the tool may pivot along an axis generally perpendicular to the front side of said frame;

means connected to the frame for lowering and raising the tool;

means connected to the frame for supporting and driving said frame;

a pump structurally independent from the frame for creating a flow of fluid; and a plurality of conduits connected to the structurally independent pump and to the means for driving the frame, said latter means driving the frame in response to the flow of fluid through said conduits.

2. The apparatus of claim 1 wherein the means for lowering and raising the tool comprises a hydraulic cylinder.

3. The apparatus of claim 1 wherein said means for supporting and driving comprises a plurality of wheels.

4. The apparatus of claim 2 wherein said hydraulic cylinder is connected to one or more wheels.

5. The apparatus of claim 1 wherein said tool is a blade type tool.

6. The apparatus of claim 1 wherein said tool comprises a motor.

7. The apparatus of claim 1 further comprising means connected to said tool for adjusting the angle of the tool along a horizontal axis generally parallel to the front side of said frame.

8. The apparatus of claim 7 wherein the means for adjusting comprises an angle adjusting bolt.

9. The apparatus of claim 1 wherein said means for supporting and driving said frame comprises a plurality of drive wheels connected to said frame.

10. The apparatus of claim 9 wherein said means for driving said frame further comprises;

a wheel motor for each drive wheel wherein each wheel motor is connected to a drive wheel;

a pump for each wheel motor wherein each pump is connected to said frame and where each pump provides a flow of fluid to power a wheel motor; and a drive motor connected to the pumps to power the pumps and wherein the drive motor is connected to said plurality of conduits.

11. An apparatus for removing floor covering comprising:

a frame having a front end;

a tool pivotally connected to the frame wherein the tool may pivot along an axis generally perpendicular to the front side of the frame;

a lift cylinder connected to said frame for lowering and raising said tool wherein the lift cylinder is connected to one or more wheels; and a plurality of wheels for driving said frame.

12. The apparatus of claim 11 wherein said tool is a blade type tool.

13. The apparatus of claim 11 wherein said tool comprises a motor.

14. The apparatus of claim 11 further comprising means connected to said tool for adjusting the angle of the tool along a horizontal axis generally parallel to the front side of said frame.

15. The apparatus of claim 14 wherein the means for adjusting comprises an angle adjusting bolt.

16. The apparatus of claim 11 further comprising means connected to said tool for adjusting the angle of the tool along a horizontal axis generally parallel to the front side of said frame, and wherein said tool is pivotally connected to said frame such that said tool may pivot along an axis generally perpendicular to the front side of said frame.

* * * * *